US010788848B2

(12) United States Patent
Petenyi

(10) Patent No.: US 10,788,848 B2
(45) Date of Patent: Sep. 29, 2020

(54) VOLTAGE REGULATOR WITH CONTROLLED CURRENT CONSUMPTION IN DROPOUT MODE

(71) Applicant: STMicroelectronics Design and Application S.R.O., Prague (CZ)

(72) Inventor: Sandor Petenyi, Lysa nad Labem (CZ)

(73) Assignee: STMicroelectronics Design and Application S.R.O., Prague (CZ)

( * ) Notice: Subject to any disclaimer, the term of this patent is extended or adjusted under 35 U.S.C. 154(b) by 0 days.

(21) Appl. No.: 16/285,330

(22) Filed: Feb. 26, 2019

(65) Prior Publication Data

US 2020/0272184 A1 Aug. 27, 2020

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
CPC ..... G05F 1/70; G05F 1/56–575; H02J 3/16; H02J 3/18; H02J 3/1807; H02J 3/1814; H02J 3/1842; H02J 3/1857
USPC ..... 323/273, 274
See application file for complete search history.

(56) References Cited

U.S. PATENT DOCUMENTS 9,645,594 B2 5/2017 Petenyi
2010/0289472 A1* 11/2010 Renous ..... G05F 1/575 323/282
2016/0373103 A1* 12/2016 Miyamae ..... H03K 17/04

* cited by examiner

*Primary Examiner* — Thienvu V Tran
*Assistant Examiner* — Peter M Novak
(74) *Attorney, Agent, or Firm* — Crowe & Dunlevy

(57) ABSTRACT

An amplifier stage of an LDO regulator circuit includes an amplifier stage that generates a drive signal in response to a first voltage difference an output voltage of the LDO regulator circuit and a reference voltage. A drive stage having a quiescent current consumption is configured to generate a control signal in response to the drive signal. The control signal is applied to the control terminal of a power transistor. A dropout detector senses whether the LDO regulator circuit is operating in closed loop regulation mode or in open loop dropout mode by sensing a second difference in voltage between the drive signal and the control signal. A quiescent current limiter circuit responds to the sensed second difference by controlling the quiescent current consumption of the drive stage, and in particular limiting current consumption when the LDO regulator circuit is operating in the open loop dropout mode.

23 Claims, 4 Drawing Sheets

VOLTAGE REGULATOR WITH CONTROLLED CURRENT CONSUMPTION IN DROPOUT MODE

TECHNICAL FIELD

The present invention generally relates to voltage regulator circuits and, in particular, to a low dropout (LDO) voltage regulator circuit having a controlled current consumption in dropout mode.

BACKGROUND

Low dropout (LDO) voltage regulators are widely used devices in electronic systems. The main benefit of an LDO-type regulator is the ability to keep the output voltage VOUT regulated even if the difference between the input voltage VIN and the output voltage VOUT is very low (for example, about 100 mV). If the input voltage VIN is sufficiently high, the output voltage VOUT is at nominal level and the regulator operates in a closed loop state. This regulation mode can be considered as the main operating condition of the LDO voltage regulator where the operating points of the circuit are well set with a low overall current consumption. However, if the input voltage VIN drops, the LDO voltage regulator can pass to an open loop operating state (referred to in the art as the dropout condition or dropout mode). This open loop state is characteristic with a significant change of the operating point, especially relating to the gate to source voltage (VGS) of the power MOSFET transistor which can increase up to the input voltage VIN level. In the high performance LDO voltage regulator, the bias (or quiescent) current of power MOSFET transistor usually depends on the VGS. If the VGS increases in the dropout mode, then the bias current increases as well.

The increased bias current consumption of the voltage regulator can be a significant concern. As an example, consider a system which includes an LDO voltage regulator that is powered from a battery. As the battery discharges, the input voltage VIN supplied from the battery drops, and the operating state of the LDO voltage regulator passes from the closed loop (regulation mode) state to the open loop (dropout mode) state. The VGS of the power MOSFET transistor increases in the dropout mode causing a corresponding increase in the bias current which can quickly deplete the remaining charge stored in the battery. This behavior is undesired and it can compromise the system operating time or it can even threaten the battery safety.

Because the dropout mode condition has to be considered as a standard circuit operating state, it is necessary to keep the current consumption under control in this mode. This can be achieved by a circuit that is able to detect the dropout condition and to limit the quiescent current of important circuit branches of the regulator circuit in this condition.

There is a need in the art for a solution for maintaining the LDO voltage regulator current consumption low (controlled) in the dropout condition.

SUMMARY

To address the problem with controlling current consumption (i.e., quiescent current) of an LDO regulator in the dropout condition, a circuit monitors the operation of the regulator circuit and intervenes when the regulation loop is near or inside the dropout condition. The quiescent current control in the dropout mode is necessary because this mode can occur in the normal course of regulator operation and can remain in place for a long time. Without the intervention of the circuit, the quiescent current of the LDO regulator in the dropout mode can increase, for example by an order of magnitude, even if the load current (ILOAD) is zero. The intervention circuit is useful and applicable inside the differential amplifier (OPAMP) of the LDO regulator. It is especially suited for OPAMP circuits being adaptively biased proportionally to the load current. This is the case with most high performance LDO regulators where the bias current of the output driver stage and other stages of the differential amplifier depends on the load current. The relationship between the load current and the driver bias current is usually realized through the VGS of the power MOSFET. In the closed loop (regulation mode) condition, the VGS of the power MOSFET (being in saturation region) is relatively low. Consequently, the driver bias current is low. In the open loop (dropout mode) condition, however, the VGS of the power MOSFET is maximized by the driver. This results in a significant increase in the driver bias current even if the load current is zero. A voltage regulator with an intervention circuit as provided herein allows for keeping the quiescent current in the dropout mode at a similar value to the closed loop condition. This is accomplished by having the intervention circuit monitor the operational status of the driver stage for the OPAMP by comparing the differential voltage VDIF generated by the OPAMP and the gate drive voltage of the power transistor. If the voltage difference is sufficiently low then the intervention circuit does not influence regulator operation. However, in the case where the voltage difference is too high, the quiescent bias current of the output stage and other stages of the OPAMP is limited by the intervention circuit.

In an embodiment, a voltage regulator comprises: an input terminal configured to receive an input voltage; an output terminal configured to supply an output voltage; a power transistor having a first conduction terminal coupled to the input terminal, a second conduction terminal coupled to the output terminal, and a control terminal; a differential amplifier having: a first stage with a first input configured to receive a reference voltage, a second input configured to receive a feedback voltage derived from the output voltage, and an output configured to provide a drive signal based on a first difference in voltage between the reference voltage and the feedback voltage; and a second stage with a driver circuit comprising a variable impedance circuit coupled to the control terminal of said power transistor, and a driver transistor having a first conduction terminal coupled to the control terminal of said power transistor, and a control terminal configured to receive the drive signal; and a dropout detector and quiescent current limiter circuit configured to sense a second difference in voltage between a voltage of the drive signal and a voltage at the control terminal of said power transistor and modify an impedance of the variable impedance circuit in response to the sensed second difference.

In an embodiment, a circuit comprises: a low dropout voltage regulator circuit that operates in a closed loop regulation mode and an open loop dropout mode, the low dropout voltage regulator circuit comprising: an amplifier stage configured to generate a drive signal in response to a first difference in voltage between an output voltage of the low dropout voltage regulator circuit and a reference voltage; a drive stage having a quiescent current consumption and configured to generate a control signal in response to the drive signal; and a power transistor having a control terminal configured to receive the control signal; and a dropout detector and quiescent current limiter circuit configured to sense a second difference in voltage between the drive signal and the control signal that is indicative of the low dropout voltage regulator circuit operating in the open loop dropout mode and in response thereto limit the quiescent current consumption of the drive stage.

BRIEF DESCRIPTION OF THE DRAWINGS

For a better understanding of the embodiments, reference will now be made by way of example only to the accompanying figures in which.

DETAILED DESCRIPTION

Figure 1:
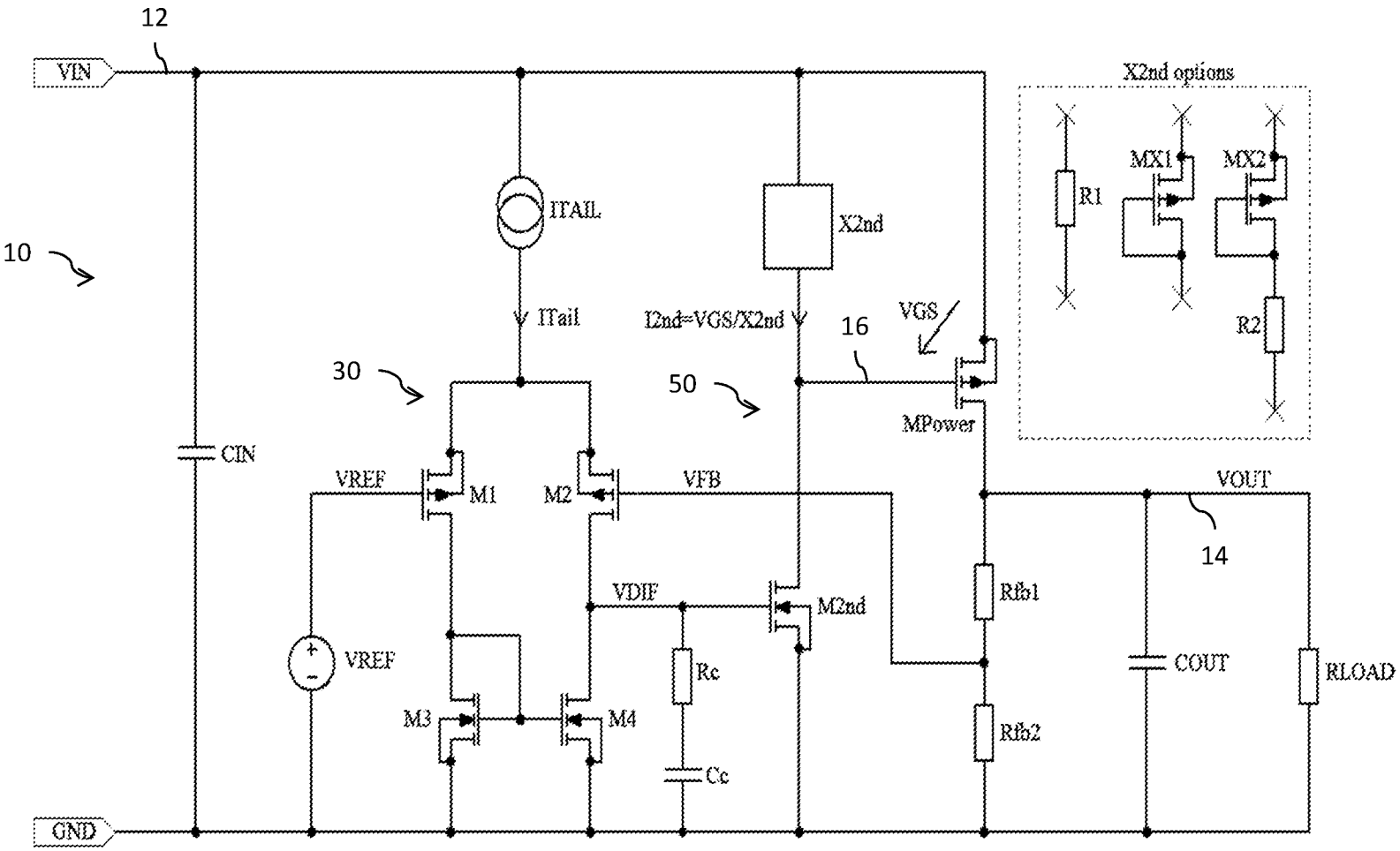
FIG. 1 (Prior Art)
FIG. 1 is a circuit diagram of a prior art low dropout voltage regulator.

Reference is now made to FIG. 1 which shows a circuit for a prior art voltage regulator 10 (see, FIG. 1 of U.S. Pat. No. 9,645,594, incorporated herein by reference). The voltage regulator 10 includes an input terminal 12 configured to receive an input voltage VIN (decoupled by an input capacitance CIN), an output terminal 14 configured to supply an output voltage VOUT, and an n-channel MOSFET power transistor MPower having a source conduction terminal coupled to the input terminal 12, a drain conduction terminal coupled to the output terminal 14 and a control (gate) terminal coupled to node 16. An input (or first) stage of a differential amplifier 30 has a first input configured to receive a voltage reference VREF and a second input configured to receive a feedback signal VFB which is derived from the output voltage VOUT. An output of the input stage of the differential amplifier 30 generates a drive signal VDIF based on a voltage difference between the voltage reference VREF and the feedback signal VFB.

A constant current source ITAIL is coupled to bias the input stage of the differential amplifier 30. The current source ITAIL is coupled between the input terminal 12 and first pair of n-channel MOSFET differential input transistors M1, M2 for the differential amplifier 30. The transistors M1, M2 are coupled to a second pair of p-channel MOSFET load transistors M3, M4, respectively, for the input stage. The gates (control terminals) of the first pair of transistors M1, M2 define the first and second inputs (for the signals VREF and VFB) of the differential amplifier 30 input stage. The second pair of transistors M3, M4 is configured as a current mirror, and the output VDIF is taken at the common drain terminals of transistors M2 and M4.

More particularly, the transistor M1 has a source conduction terminal coupled to the constant current source ITAIL, a control terminal forming the first input that is coupled to a voltage reference (for example, a bandgap voltage generator) providing the reference voltage VREF, and a drain conduction terminal. The transistor M2 has a source conduction terminal coupled to the constant current source ITAIL, a control terminal forming the second input that receives the feedback signal VFB, and a drain conduction terminal coupled to the output that provides the drive signal VDIF.

The transistor M3 has a drain conduction terminal coupled to the drain conduction terminal of the transistor M1, a control terminal, and a source conduction terminal coupled to ground. The transistor M4 has a drain conduction terminal coupled to the drain conduction terminal of the transistor M2 (where the signal VDIF is generated), a control terminal coupled to both the drain conduction terminal and the control terminal of the transistor M3, and a source conduction terminal coupled to ground. The drive signal VDIF is filtered by a compensation filter circuit formed by series connected resistor Rc and capacitor Cc to ensure stable operation.

An output (or second) stage of the differential amplifier 30 includes an inverting driver circuit 50 formed by an impedance circuit device X2*nd* coupled to the control terminal of the power transistor MPower at node 16 and an n-channel MOSFET driver transistor M2*nd*. The output stage provides several functions—signal amplification, level shifting and power MOSFET driving. The driver transistor M2*nd* is an n-channel MOSFET having a drain conduction terminal coupled to the control terminal of the power transistor Mpower at node 16, a source conduction terminal coupled to a ground GND reference voltage, and a control terminal configured to receive the drive signal VDIF from the differential amplifier 30 input stage so as to vary a bias current I2*nd* applied by the output stage to the control terminal of the power transistor MPower. The driver transistor M2*nd* is loaded by the impedance circuit device X2*nd* whose real circuit implementation depends on demanded regulation characteristics and loop stability requirements. The transconductance of driver transistor M2*nd* together with the impedance of the impedance circuit device X2*nd* defines the voltage gain of the output stage of the differential amplifier 30.

Since the output of the driver circuit 50 is coupled to the gate terminal of the power transistor MPower at node 16, a voltage formed across the impedance circuit device X2*nd* represents the VGS of the power transistor. In other words, the drain current of driver transistor M2*nd* generates a voltage drop on the impedance circuit device X2*nd* that is used for driving the power transistor MPower. Because the impedance circuit device X2*nd* is tied to the input voltage VIN, the voltage drop is level-shifted respect the output voltage VDIF. With changes in the load current of the voltage regulator 10 (where load current ILOAD is the current passing through the power transistor Mpower and applied to the load represented by load capacitance COUT and load impedance RLOAD), the VGS of the power transistor also changes. The relation between the load current and VGS is given by a transfer function of the power transistor MPower, where the transfer function is valid when the power transistor MPower is operating in the saturation region. This corresponds to the voltage regulator 10 operating in the closed loop or regulation mode condition. Since the impedance circuit device X2*nd* is operating between the node 16 and the source conduction terminal of the power transistor MPower, the bias current I2*nd* of the driver circuit 50 depends on the load current.

The impedance circuit device X2*nd* may comprise any one of a number of circuit configurations as shown, including: a resistor R1 coupled between the input voltage VIN and the node 16; a diode-connected MOSFET MX1 coupled between the input voltage VIN and the node 16; and a series connection of a diode-connected MOSFET MX2 and a resistor R2 coupled between the input voltage VIN and the node 16. The respective impedances of these three different circuit configurations of the impedance circuit device X2*nd* are generically referenced as Rx. Consequently, the bias current I2*nd* is based on the following relationship: I2*nd*=VGS/Rx.

The power transistor MPower is a p-channel MOSFET. The VGS of the power transistor MPower is varied by the drain or bias current I2*nd* of the driver transistor M2*nd*. The VGS is thus defined by the following relationship: VGS=I2*nd**Rx.

The bias current I2*nd* is controlled by the output voltage VDIF of the differential amplifier 30 input stage. This relationship is given by the transconductance gm of the driver transistor M2*nd*, and is defined as follows: I2*nd*=gm*VDIF.

The feedback signal VFB is generated by a voltage divider circuit formed by resistors Rfb1 and Rfb2. The feedback signal VFB is thus a scaled replica of the output voltage VOUT as given by the following: VFB=VOUT*(Rfb2/(Rfb1+Rfb2)).

The output voltage VOUT is then a scaled replica of the reference voltage VREF provided by the voltage reference. The relationship between the reference voltage VREF and the output voltage VOUT is given by the following: VOUT=VREF*((Rfb1+Rfb2)/Rfb2). The feedback with the differential amplifier 30 operation assures that the feedback signal VFB equals the voltage reference VREF Since the impedance circuit device X2*nd* is operating between the control terminal and the first conduction terminal of the power transistor MPower, the bias current I2*nd* of the driver transistor M2*nd* depends on the load current. If the voltage difference (referred to as the drop voltage VDROP) between the input voltage VIN and the output voltage VOUT is sufficiently high, the power transistor MPower stays in the saturation region and the VGS of the power transistor is relatively low (for example, below 1 V). This results in a low bias current I2*nd* within the driver circuit 50 and the voltage regulator 10 operates in the closed loop (regulation mode) condition.

However, if the voltage difference VDROP becomes too low so that the voltage regulator 10 is not able to maintain operation in the closed loop state, then operation of the power transistor MPower passes to a linear (triode) region. This corresponds to the voltage regulator 10 operating in the dropout mode condition.

In the dropout mode, the dependence between the load current and the VGS of the power transistor MPower is no longer given by the transfer function of the power transistor, and the VGS can reach a very high level. In fact, the driver circuit 50 can pull the control terminal of the power transistor Mpower at node 16 down to a voltage level near ground GND, and the VGS of the power transistor can approach the input voltage VIN. If the VGS increases in the dropout mode, then the bias current I2*nd* in the output stage of the amplifier 30 increases as well. This is because the bias current I2*nd* depends on the VGS of the power transistor. Since the driver circuit 50 operates over the VGS of the power transistor MPower, the bias current I2*nd* can reach a very high level. In the case of VIN=5 V and a resistive load of the driver transistor M2*nd*, the bias current I2*nd* can be five times higher than the bias at the maximum load current. This is valid even if the load current is zero when current consumption of the voltage regulator 10 should be minimal. For a battery powered electronic device, this means that when the battery becomes discharged and the voltage regulator 10 passes to the dropout mode, even more quiescent current starts to sink.

Figure 2:
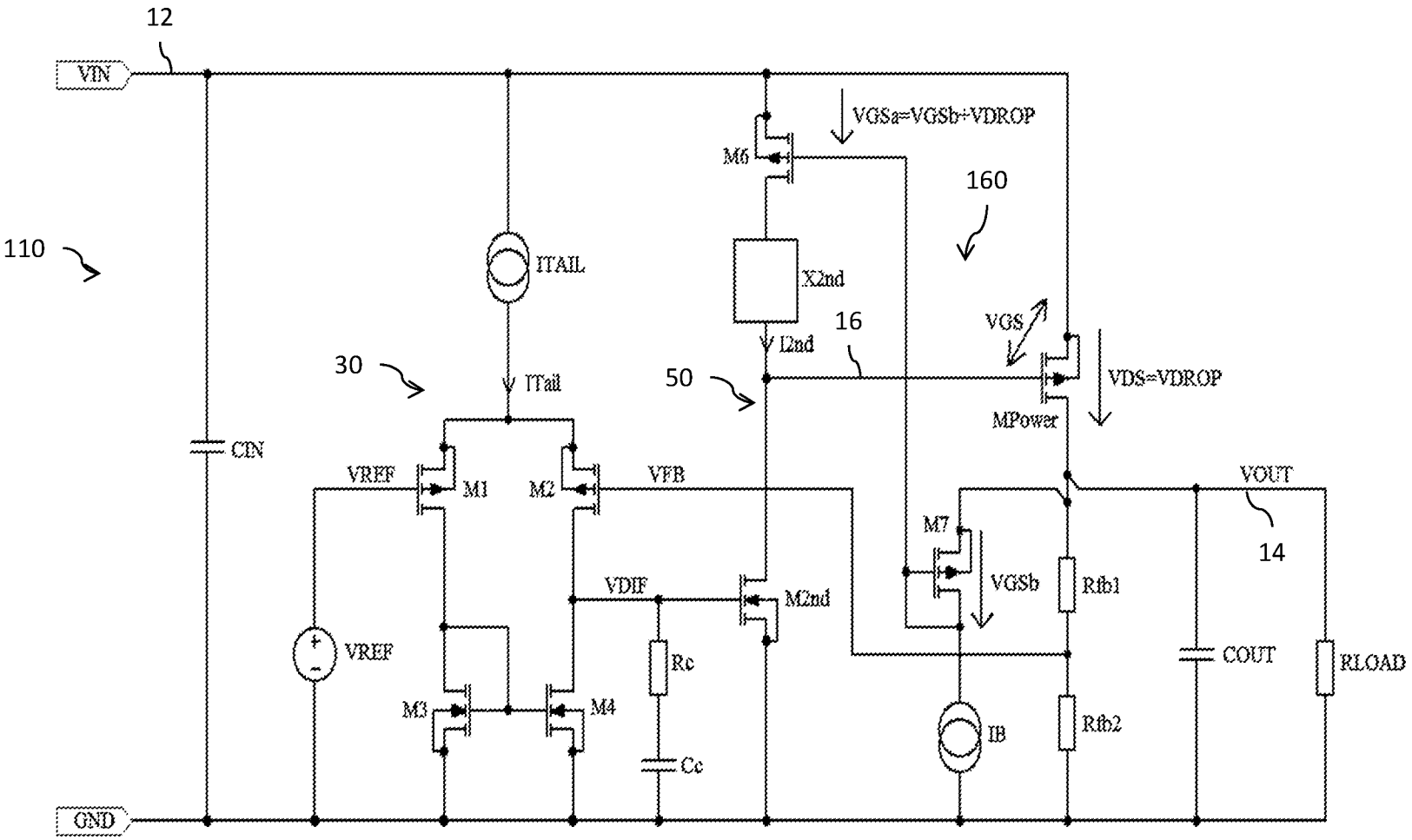
FIG. 2 (Prior Art)
FIG. 2 is a circuit diagram of a prior art low dropout voltage regulator with current consumption control.

To address this problem, FIG. 2 shows a circuit for a prior art voltage regulator 110 (see, FIG. 2 of U.S. Pat. No. 9,645,594, incorporated herein by reference) configured to limit quiescent current consumption when the regulator drops out of regulation in the closed loop state. Like references in FIGS. 1 and 2 refer to like or similar components whose description will not be repeated. The voltage regulator 110 differs from the voltage regulator 10 due to the inclusion of a dropout detector and quiescent current limiter circuit 160 which operates to limit quiescent current consumption when voltage regulator 110 operation falls into the open loop condition associated with the dropout mode.

The dropout detector and quiescent current limiter 160 is coupled to the power transistor MPower and includes a first p-channel MOSFET transistor M6, a second n-channel MOSFET transistor M7 and a bias current generator IB. The first transistor M6 has a source conduction terminal coupled to the input terminal 12, a drain conduction terminal coupled to the impedance circuit device X2*nd*, and a control gate terminal. The second transistor M7 has a source conduction terminal coupled to the output terminal 14, a drain conduction terminal and a control gate terminal, where the drain and control gate conduction terminals are coupled to each other and to the control terminal of the first transistor M6. The bias current generator IB is coupled between the drain/gate conduction terminals of the second transistor M7 and ground 115 and provides a bias current.

The second transistor M7 is biased by the bias current generator IB so as to define a potential at the control terminals of transistors M6 and M7 that is one VGS below the output voltage VOUT. Since the gate conduction terminals of the first and second transistors M6, M7 are shorted together, the VGS of the first transistor M6 is given by the following. $VGS_{M6}=VGS_{M7}+VDROP$.

This means that the higher the difference in voltage between the input voltage VIN and the output voltage VOUT, the higher the VGS overdrive of the first transistor M6. The VGS overdrive is an expression and parameter used to specify operation of a transistor in the linear region. If the voltage regulator 110 is operating in a closed loop condition, then the first transistor M6 is in the linear region. In fact, the first transistor M6 operates as a switch which does not influence the operation of the regulator circuit.

If the load current ILOAD is zero and the input voltage VIN is below the nominal level of the output voltage VOUT, then the voltage regulator 110 is operating in the dropout mode. In this specific case the VDROP will be zero and the following relationship is provided: $VGS_{M6}=VGS_{M7}$. As a result, the first and second transistors M6, M7 form a current mirror and the bias current I2*nd* of the driver circuit 50 will be given by the bias current generated by the bias current generator IB (i.e., I2*nd*=IB).

Operation of transistors M6, M7 as a current mirror for reducing current consumption when the voltage regulator 110 is operating in the dropout mode condition will now be discussed. In the dropout mode, the power transistor MPower is operating in the linear region and may be represented by a resistance RDSON. The first and second transistors M6, M7 are the same (i.e., they are replicas of each other). If the load current ILOAD is zero, then the current through the resistor RDSON is equal to the bias current provided by current source IB. This bias current can, for example, be a range of a few tens of nanoAmps, so the voltage drop across resistance RDSON is practically zero. The resistance RDSON may have a value of 1Ω, for example. With a voltage drop of practically zero across the resistance RDSON, this is equivalent to a short, which in turn provides transistors M6 and M7 as a current mirror. Consequently, the bias current I2*nd* will equal the bias current IB. In other words, the driver circuit 150 is adaptively biased and this sets the maximum current which can flow through the driver circuit 150. The bias current from the bias current generator IB is a constant current setting the maximum quiescent current.

If the voltage regulator 110 is operating in the dropout mode, but the load current ILOAD is not zero, there will be some voltage drop on the resistance RDSON, which is based on the following relationship: VDROP=RDSON*ILOAD, where ILOAD is the load current. Contribution from the bias current source IB is negligible. The VGS of the first transistor M6 will be higher than the VGS of the second transistor M7. This will cause a certain increase in the bias current I2*nd*. The VGS of the first transistor M6 is given by the following relationship: $VGS_{M6}=VGS_{M7}+VDROP$. Even though the bias current I2*nd* will be higher than the bias current from the bias current source IB, the current is still limited.

By properly sizing of the first and second transistors M6, M7 and the bias current generator IB it is possible to find a good compromise between the dropout mode current consumption and loop stability. Loop stability is an important factor for the sizing of the components. When the dropout detector and quiescent current limiter 160 is starting to limit the bias current I2*nd* in the driver circuit 150, the impedance conditions of the driver are changing significantly.

The dropout detector and quiescent current limiter 160 addresses the problem with high quiescent current consumption in dropout mode by sensing a voltage difference between VIN and VOUT nodes (i.e., the voltage drop across the power MOSFET) and limiting the amount of current in the driver stage (and other stages) in the dropout mode. It will be noted that this solution has some limitation especially when applied in an LDO regulator with an ultra-low dropout voltage (bellow 100 mV) at maximum load current. The limitation is related to low overdrive voltage for the transistor M6 (in the case of low dropout voltage) along with consequent issues concerning loop stability near the dropout mode of the LDO regulator.

Figure 3:
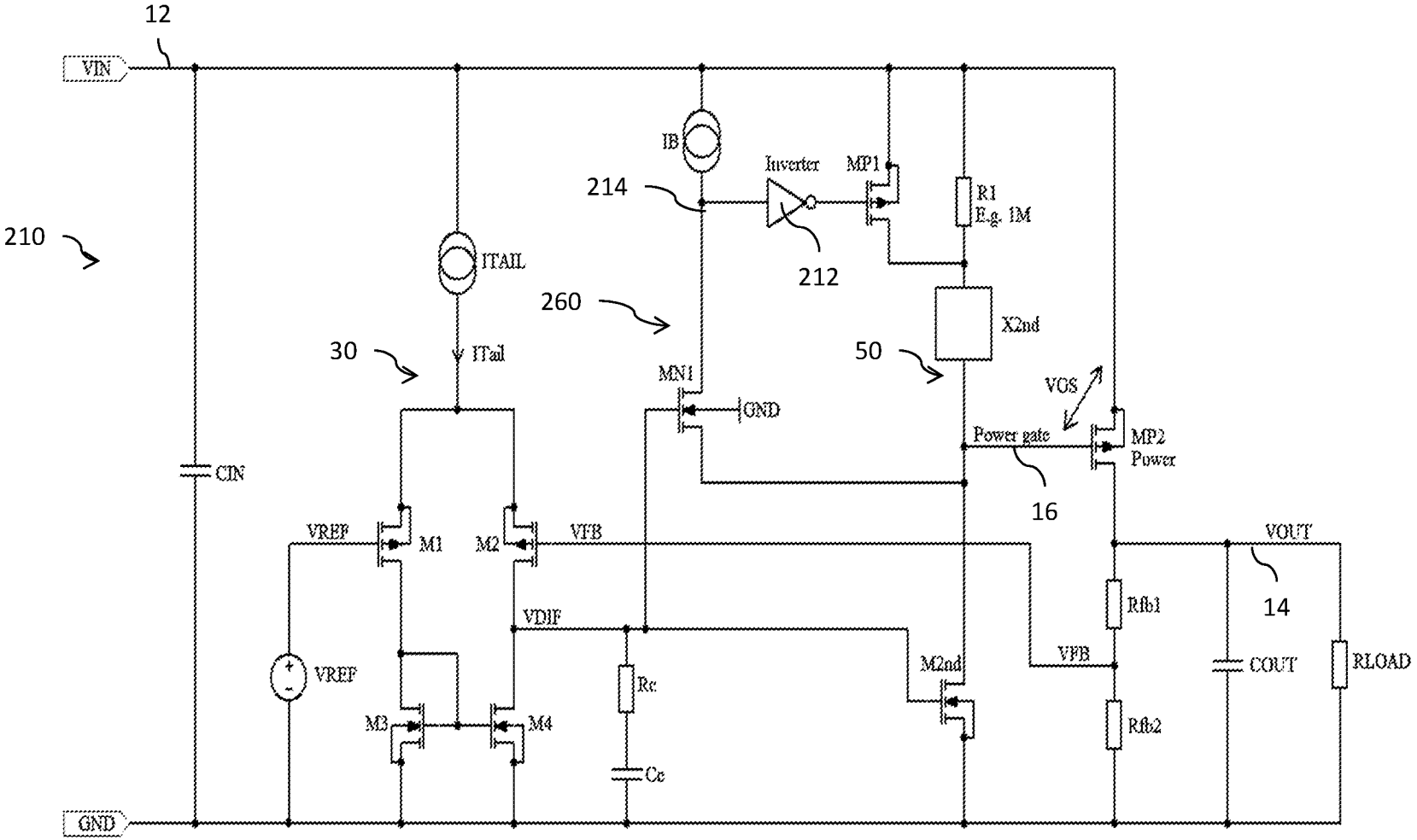
FIG. 3 is a circuit diagram of a low dropout voltage regulator with current consumption control.

To address the foregoing limitation, FIG. 3 shows a circuit for a voltage regulator 210 configured to limit quiescent current consumption when the regulator drops out of regulation in the closed loop state like references in FIGS. 1, 2 and 3 refer to like or similar components whose description will not be repeated. The voltage regulator 210 differs from the voltage regulator 110 due to the inclusion of a different dropout detector and quiescent current limiter circuit 260 which operates to limit quiescent current consumption when voltage regulator 210 operation falls into the open loop condition associated with the dropout mode. Compared to the circuit 160 which operated to detect the dropout mode by monitoring voltage difference between VIN and VOUT levels, the circuit 260 instead monitors the status of the driver circuit 150 to detect the dropout mode and control quiescent current consumption.

The dropout detector and quiescent current limiter circuit 260 embedded into the regulator 210 is formed by an n-channel MOSFET transistor MN1, a bias current source IB, a CMOS logic inverter 212, a p-channel MOSFET transistor MP1 and resistor R1. The transistor MN1 has a first conduction terminal coupled to the node 16, a second conduction terminal, and a control gate terminal coupled to receive the signal VDIF. Thus, the transistors MN1 and M2*nd* share a common gate connection, with the source terminal of transistor MN1 connected to the drain terminal of transistor M2*nd*. The body terminal of transistor MN1 is tied to ground. The bias current source IB is coupled between the input terminal 12 and the second conduction terminal of the transistor MN1 at node 214. An input terminal of the CMOS logic inverter 212 is coupled at node 214 to the output of the bias current source IB and the second conduction terminal of the transistor MN1. The transistor MP1 has a source conduction terminal coupled to the input terminal 12, a drain conduction terminal coupled to the impedance circuit device X2*nd*, and a control gate terminal coupled to an output of the CMOS logic inverter 212. The resistor R1 is connected in parallel with the transistor MP1, with one terminal coupled to the input terminal 12 and another terminal coupled to the impedance circuit device X2*nd*. The resistor R1 and impedance circuit device X2*nd* form a variable impedance circuit whose impedance is controlled by a switching action of the transistor MP1. The inverter 212 is accommodated for accepting a semi-digital signal generated by transistor MN1 and current source IB. In particular, the inverter 212 is constructed for minimal cross-conductance when its input voltage is between low and high levels. The inverter 212 generates a control signal for driving the gate of transistor MP1 and thus controlling the on/off state of transistor MP1 functioning as a transistor switch. Turning on of transistor MP1 shorts the resistor R1 which in coupled in series with the impedance circuit device X2*nd* and thus changes the impedance of the variable impedance circuit.

The circuit 260 functions to detect the status of the output stage of the differential amplifier 30. When in the closed loop state for the regulation mode condition, meaning that the input voltage VIN is sufficiently high for maintaining the output voltage VOUT in regulation, the transistor M2*nd* is in saturation mode, the transistor MN1 has a negative VGS due to the difference in voltage between VDI and node 16, the input of the inverter 212 at node 214 is high, the gate of transistor MP1 is low to turn on transistor MP1, and the resistor R1 is shorted. In this operational state, the circuit 260 does not influence the normal operation of the driver transistor M2*nd* working with the impedance circuit device X2*nd*. In principle, transistor MN1 is used for distinguishing the operation mode of the driver stage. Normally, in the regulation mode, the voltage of the signal VDIF output from the input stage of the differential amplifier 30 node is defined by the VGS of driver transistor M2*nd* which can be around 0.8V and the voltage at node 16 is defined by the VGS of the power transistor MPower (being around 0.8V) referred to the input voltage VIN. This means that the voltage of the drain terminal of the driver transistor M2*nd* is high, more precisely given by $VIN-VGS_{(MP2)}$. As a result, driver transistor M2*nd* is set in saturation mode. In this condition, the VGS of transistor MN1 is negative. The drain terminal of transistor MN1 sinks no current and the input of the inverter 212 is pulled up to the input voltage VIN level by the constant bias current source IB. The output of the inverter 212 is accordingly low to set a maximum VGS for transistor MP1, which turns on transistor MP1 and shorts the resistor R1.

When the input voltage VIN drops to a level such that the loop is not able keep the output voltage VOUT regulated and the regulator is in the open loop (dropout mode) condition, significant operating point changes occur in the circuit 260. Because the loop is trying to maintain regulation, the signal VDIF driven by the input stage of the differential amplifier 30 is pulled up and node 16 driven by the transistor M2*nd* is pulled down. The node at which the signal VDIF is output saturates at some high level (given by construction of the differential stage) and the voltage at node 16 drops to near the GND level. The voltage difference between these two nodes (i.e., the VDIF node and node 16) is sensed by transistor MN1 which turns on when a sufficient VGS (defining a threshold for comparison of the voltages VDIF and Vnode16) is formed between gate and source terminals. When this happens, the drain of transistor MN1 consumes all the bias current from bias current source IB and the voltage at the input node 214 of the inverter 212 is pulled down. In response, the output of inverter 212 goes up causing the transistor MP1 to turn off. This will remove the short of resistor R1, and now resistor R1 and impedance X2*nd* are connected in series between the input voltage VIN and node 16. Because the resistance value of resistor R1 is much higher than the resistance of impedance circuit device X2*nd* (for example, by orders of magnitude, such as R1=1 MΩ and X2*nd*=20 KΩ), the current flowing through the driver circuit 50 is reduced significantly. The change of the impedance in the output stage of the differential amplifier 30 does not cause instability because the regulator is already in dropout mode and no regulation is performed. The exact detection and activation point of the circuit 260 can be tuned by sizing the transistor MN1. It is important to activate the current limitation only when the loop is completely open—i.e., no regulation is present.

Figure 4:
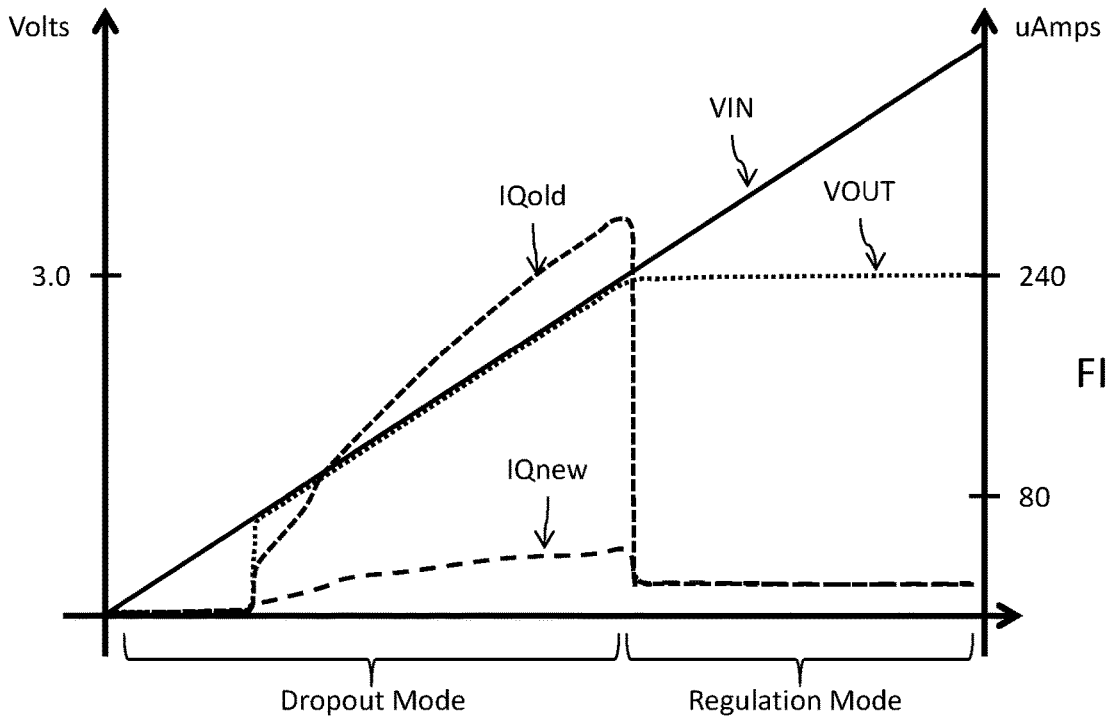
FIGS. 4-5 show simulation results for operation of the circuit of FIG. 3.
Figure 5:
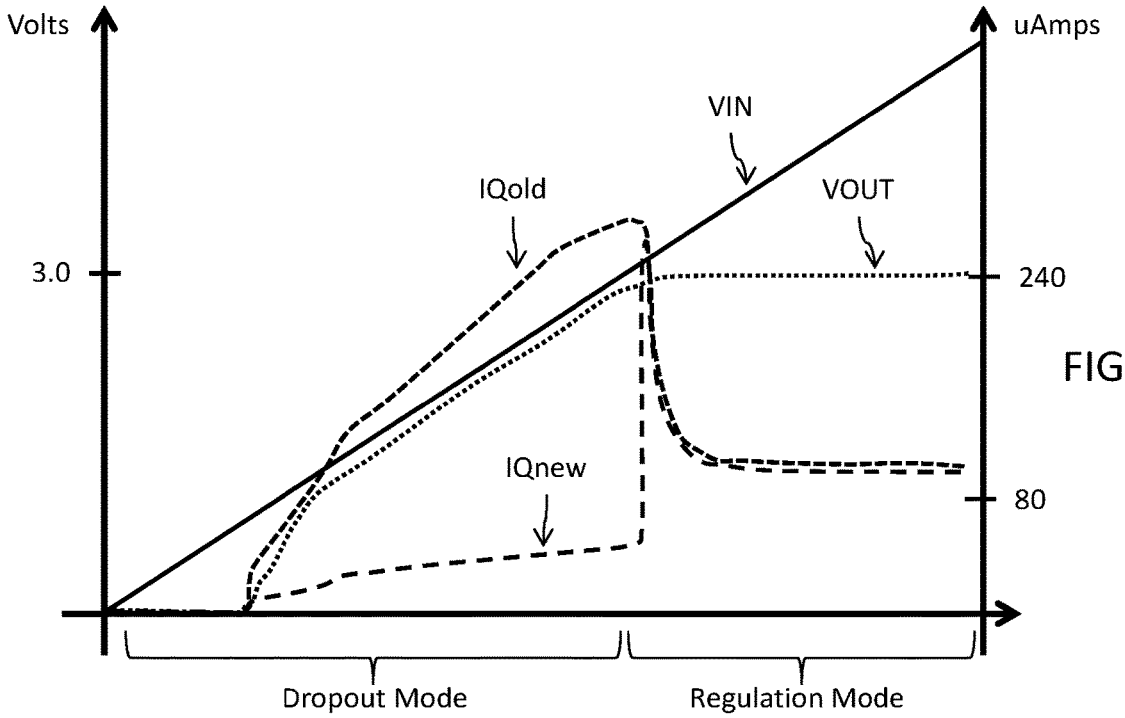

The circuit as shown in FIG. 3 has been simulated to confirm operation. Results of the simulation are depicted in FIGS. 4-5. FIG. 4 shows a simulation where the load current is set to OA and FIG. 5 shows a simulation where the load current is set to 100 mA. The nominal output voltage VOUT is 3.0V. The X-axis represents time, the left Y-axis represents voltage and the right Y-axis represents current. In this transient (time domain) simulation, the input voltage VIN is swept from 0V to 5V and the output voltage VOUT and the ground pin quiescent current IQ is monitored. Each graph shows two cases for the monitored quiescent current—one without the use of circuit 260 (IQold) and one with the use of circuit 260 (IQnew). The output voltage VOUT characteristic is plotted just once because the circuit 260 is not influencing the VOUT regulation characteristic. Instead, the circuit 260 functions to alter the quiescent current IQ significantly. Without the use of circuit 260, in the dropout mode the quiescent current IQold level can reach current consumption over 240 uA, even with zero load current ILOAD as shown in the FIG. 4 simulation, whereas the normal consumption in regulation mode is just about 15 uA. With use of the circuit 260, the quiescent current IQ level in the dropout mode is decreased dramatically down to about 50 uA.

In the case of the simulation with a 100 mA load current as depicted in FIG. 6, the quiescent current IQ level in the dropout mode is even lower compared to the regulation mode. More precisely, the quiescent current IQ level is about 50 uA in the dropout mode versus about 100 uA in the regulation mode. There is some peak visible on the IQ characteristic caused by late activation of the circuit 260. But this is inevitable because the bias current reduction cannot be activated before the circuit 210 is surely in the dropout mode. Otherwise there is a risk of oscillation. But the peak is occurring in just a small range of the input voltage VIN, and is of little to no concern given the advantage of the presence of the circuit 260 in controlling current consumption.

While the invention has been illustrated and described in detail in the drawings and foregoing description, such illustration and description are considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

What is claimed is:

1. A voltage regulator, comprising:

an input terminal configured to receive an input voltage;

an output terminal configured to supply an output voltage;

a power transistor having a first conduction terminal coupled to the input terminal, a second conduction terminal coupled to the output terminal, and a control terminal;

a differential amplifier having:

a first stage with a first input configured to receive a reference voltage, a second input configured to receive a feedback voltage derived from the output voltage, and an output configured to provide a drive signal based on a first difference in voltage between the reference voltage and the feedback voltage; and a second stage with a driver circuit comprising a variable impedance circuit coupled to the control terminal of said power transistor, and a driver transistor having a first conduction terminal coupled to the control terminal of said power transistor, and a control terminal configured to receive the drive signal; and a dropout detector and quiescent current limiter circuit configured to sense a second difference in voltage between a voltage of the drive signal and a voltage at the control terminal of said power transistor and modify an impedance of the variable impedance circuit in response to the sensed second difference.

2. The voltage regulator of claim 1, wherein the variable impedance circuit comprises a first impedance and a second impedance connected in series between the input terminal and the control terminal of said power transistor, and wherein the dropout detector and quiescent current limiter circuit comprises a transistor switch controlled in response the sensed second difference to short across the first impedance when the voltage regulator is operating in the closed loop regulation mode and not short across the first impedance when the voltage regulator is operating in the open loop dropout mode.

3. The voltage regulator of claim 2, wherein a value of the first impedance is greater than a value of the second impedance.

4. The voltage regulator of claim 2, wherein the first impedance is a resistor and the second impedance is an impedance circuit selected from the group consisting of: a resistor, a diode and a series connection of a resistor and a diode.

5. The voltage regulator of claim 1, wherein the dropout detector and quiescent current limiter circuit comprises:

a first transistor having a first conduction terminal coupled to the control terminal of said power transistor, a second conduction terminal, and a control terminal coupled to receive the drive signal;

a current source coupled to the second conduction terminal of the first transistor;

an inverter circuit having an input coupled to the second conduction terminal of the first transistor; and an impedance control circuit having an input coupled to an output of the inverter circuit, said impedance control circuit configured to modify the impedance of the variable impedance circuit.

6. The voltage regulator of claim 5, wherein the variable impedance circuit comprises a first impedance and a second impedance connected in series between the input terminal and the control terminal of said power transistor, and wherein the impedance control circuit comprises a transistor switch controlled to selectively short across the first impedance in response to the output of the inverter circuit.

7. The voltage regulator of claim 6, wherein the transistor switch shorts across the first impedance when the dropout detector and quiescent current limiter circuit senses that the voltage regulator is operating in closed loop regulation mode and does not short across the first impedance when the dropout detector and quiescent current limiter circuit senses that the voltage regulator is operating in open loop dropout mode.

8. The voltage regulator of claim 1, wherein:

if the sensed second difference indicates that the voltage regulator is operating in the closed loop regulation mode, the dropout detector and quiescent current limiter circuit controls the impedance of the variable impedance circuit to have a relatively lower value; and if the sensed second difference indicates that the voltage regulator is operating in the open loop dropout mode, the dropout detector and quiescent current limiter circuit controls the impedance of the variable impedance circuit to have a relatively higher value.

9. The voltage regulator of claim 1, wherein the modification of the impedance of the variable impedance circuit in response to the sensed second difference comprises:

setting a lower impedance for the variable impedance circuit if the sensed second difference is lower than a threshold; and setting a higher impedance for the variable impedance circuit if the sensed second difference is higher than the threshold.

10. The voltage regulator of claim 9, wherein the threshold is defined by a gate to source voltage of a sensing transistor of the dropout detector and quiescent current limiter circuit, said sensing transistor having a gate terminal coupled to receive the drive signal and a conduction terminal coupled to the control terminal of said power transistor.

11. The voltage regulator of claim 10, wherein a signal at a further conduction terminal of the sensing transistor drives a switching operation to switch between the lower and higher impedances.

12. A low dropout voltage regulator circuit that operates in a closed loop regulation mode and an open loop dropout mode, the low dropout voltage regulator circuit comprising:

an amplifier stage configured to generate a drive signal in response to a first difference in voltage between an output voltage of the low dropout voltage regulator circuit and a reference voltage;

a drive stage having a quiescent current consumption and configured to generate a control signal in response to the drive signal; and a power transistor having a control terminal configured to receive the control signal; and a dropout detector and quiescent current limiter circuit configured to sense a second difference in voltage between the drive signal and the control signal that is indicative of the low dropout voltage regulator circuit operating in the open loop dropout mode and in response thereto limit the quiescent current consumption of the drive stage.

13. The voltage regulator circuit of claim 12, wherein the drive stage includes a variable impedance circuit coupled to the control terminal of said power transistor, and wherein the dropout detector and quiescent current limiter circuit operates to modify an impedance of the variable impedance circuit in response to the sensed second difference.

14. The voltage regulator circuit of claim 13, wherein the variable impedance circuit comprises a first impedance and a second impedance connected in series between an input terminal of the low dropout voltage regulator circuit and the control terminal of said power transistor, and wherein the dropout detector and quiescent current limiter circuit comprises a transistor switch controlled to short across the first impedance in the closed loop regulation mode and not short across the first impedance in the open loop dropout mode.

15. The voltage regulator circuit of claim 14, wherein the first impedance is a resistor and the second impedance is an impedance circuit selected from the group consisting of: a resistor, a diode and a series connection of a resistor and a diode.

16. The voltage regulator circuit of claim 13, wherein the modification of the impedance of the variable impedance circuit in response to the sensed second difference comprises:

setting a lower impedance for the variable impedance circuit if the sensed second difference is lower than a threshold; and setting a higher impedance for the variable impedance circuit if the sensed second difference is higher than the threshold.

17. The voltage regulator circuit of claim 16, wherein the threshold is defined by a gate to source voltage of a sensing transistor of the dropout detector and quiescent current limiter circuit, said sensing transistor having a gate terminal coupled to receive the drive signal and a conduction terminal coupled to the control terminal of said power transistor.

18. The voltage regulator circuit of claim 17, wherein a signal at a further conduction terminal of the sensing transistor drives a switching operation to switch between the lower and higher impedances.

19. The voltage regulator circuit of claim 12, wherein the dropout detector and quiescent current limiter circuit comprises:

a first transistor having a first conduction terminal coupled to the control terminal of said power transistor, a second conduction terminal, and a control terminal coupled to receive the drive signal;

a current source coupled to the second conduction terminal of the first transistor;

an inverter circuit having an input coupled to the second conduction terminal of the first transistor; and an impedance control circuit having an input coupled to an output of the inverter circuit, said impedance control circuit configured to modify the quiescent current consumption of the drive stage.

20. The voltage regulator circuit of claim 12, wherein:

if the sensed second difference indicates that the voltage regulator is operating in the closed loop regulation mode, the dropout detector and quiescent current limiter circuit controls the quiescent current to have a relatively higher value; and if the sensed second difference indicates that the voltage regulator is operating in the open loop dropout mode, the dropout detector and quiescent current limiter circuit controls the quiescent current to have a relatively lower value.

21. The voltage regulator circuit of claim 12:

wherein the amplifier stage has a first input configured to receive the reference voltage, a second input configured to receive a feedback voltage derived from the output voltage, and an output configured to provide the drive signal in response to a difference between the reference voltage reference and the feedback voltage; and wherein the drive stage comprises a variable impedance circuit coupled to the control terminal of said power transistor, and a driver transistor having a first conduction terminal coupled to the control terminal of said power transistor, and a control terminal configured to receive the drive signal.

22. The voltage regulator circuit of claim 21, wherein the dropout detector and quiescent current limiter circuit controls by modifying an impedance of the variable impedance circuit in response to the sensed second difference.

23. The voltage regulator circuit of claim 22, wherein the modification of the impedance of the variable impedance circuit in response to the sensed second difference comprises:

setting a lower impedance for the variable impedance circuit if the sensed second difference is lower than a threshold indicative of the low dropout voltage regulator circuit operating in the closed loop regulation mode; and setting a higher impedance for the variable impedance circuit if the sensed second difference is higher than a threshold indicative of the low dropout voltage regulator circuit operating in the open loop dropout mode.

* * * * *